US007766020B2

(12) United States Patent
Chininis et al.

(10) Patent No.: US 7,766,020 B2
(45) Date of Patent: Aug. 3, 2010

(54) HAIR RETAINING CLIP WITH RESILIENT GRIPPING MEMBER

(75) Inventors: Stephen Chininis, Norcross, GA (US); Jose Longoria, Miami, FL (US)

(73) Assignee: Goody Products, Inc., Atlanta, GA (US)

( * ) Notice: Subject to any disclaimer, the term of this patent is extended or adjusted under 35 U.S.C. 154(b) by 733 days.

(21) Appl. No.: 11/647,923

(22) Filed: Dec. 29, 2006

(65) Prior Publication Data

US 2008/0156344 A1 Jul. 3, 2008

(51) Int. Cl.
*A45D 8/22* (2006.01)

(52) U.S. Cl. ..... 132/278

(58) Field of Classification Search ..... 132/273, 132/275, 276, 278, 279; D28/42
See application file for complete search history.

(56) References Cited

U.S. PATENT DOCUMENTS

| | | | | |
|---|---|---|---|---|
| 2,669,789 | A | 1/1955 | Goodman | 132/48 |
| 2,818,871 | A | 1/1958 | Beaudry | 132/48 |
| 3,645,278 | A | 2/1972 | Abraham | 132/48 |
| 3,842,849 | A | 10/1974 | Goodman | 132/46 R |
| 4,554,934 | A | 11/1985 | Mooneyhan | 132/40 |
| 4,671,302 | A | 6/1987 | Hill | 132/9 |
| 5,228,465 | A | 7/1993 | Hill | 132/212 |
| D393,928 | S * | 4/1998 | Chou | D28/42 |
| 5,996,593 | A | 12/1999 | Horman | 132/278 |
| 6,257,251 | B1 | 7/2001 | Burleson et al. | 132/279 |
| 6,394,102 | B1 | 5/2002 | Vogel | 132/273 |
| 6,578,585 | B1 | 6/2003 | Stachowski et al. | 132/273 |
| 6,668,841 | B1 | 12/2003 | Chou | 132/278 |
| 2002/0124862 | A1 * | 9/2002 | Porter et al. | 132/278 |
| 2003/0192565 | A1 | 10/2003 | Stachowski | |
| 2004/0182412 | A1 | 9/2004 | Vogel | |
| 2006/0162738 | A1 | 7/2006 | Chudzik et al. | 132/278 |

OTHER PUBLICATIONS

International Search Report and Written Opinion; Jun. 10, 2008; 9 pgs.

* cited by examiner

*Primary Examiner*—Rachel R Steitz
(74) *Attorney, Agent, or Firm*—Gardner Groff Greenwald & Villanueva, PC

(57) ABSTRACT

A hair retaining clip includes clip members that are pivotally connected to one another and movable between a generally open configuration and a generally closed configuration. A hair gripping component is fixedly attached to one of the clip members and is made from a relatively soft material. The hair gripping component is generally shielded from contact with hair within the hair retaining clip when the clip members are in the generally open configuration, and the hair gripping component contacts hair within the hair retaining clip when the clip members are in the generally closed configuration.

20 Claims, 3 Drawing Sheets

HAIR RETAINING CLIP WITH RESILIENT GRIPPING MEMBER

TECHNICAL FIELD

The present disclosure relates generally to devices for retaining strands of hair and, more particularly, to hair retaining clips, such as those commonly known as "barrettes" and "contour clips."

BACKGROUND OF THE DISCLOSURE

Hair retaining clips, such as barrettes and contour clips that grip hair, have been developed that include components coated with rubber-like materials so that the hair retaining clips grip hair better. However, the rubber-like materials can make the barrettes and clips difficult to slide onto the hair because the hair is gripped before the clip is placed fully into a desired position on the hair.

Accordingly, there is a need for hair retaining clips, such as barrettes and contour clips, that are easy to slide into position when in an open configuration, but that also firmly grip the hair when placed in a closed configuration.

SUMMARY OF THE DISCLOSURE

According to one aspect of the disclosure a hair retaining clip includes a first clip member, a second clip member pivotally connected to the first clip member that is movable between a generally open configuration and a generally closed configuration, and a hair gripping component, fixedly attached to one of the first clip member and the second clip member, that is made from a relatively soft material. The hair gripping component is generally shielded from contact with hair within the hair retaining clip when the second clip member is in the generally open configuration, and the hair gripping component contacts hair within the hair retaining clip when the second clip member is in the generally closed configuration.

The hair retaining clip may include a hard material, such as a hard plastic, that pushes down on a soft material as the clip is closed. Portions of the soft material protrude through apertures on the top of the clip and contact the hair only when the clip is closed. When the clip is opened, only smooth surfaces, such as smooth metal surfaces, touch the hair, making it easy to position the clip properly before closing it to firmly grip the hair.

According to another aspect of the disclosure, the hair retaining clip may include a living hinge connecting the first clip member to the second clip member.

According to yet another aspect of the disclosure, the hair retaining clip is a barrette, and the hair gripping component is generally shielded from contact with hair within the barrette by a leaf spring, when the second clip member is in the generally open configuration.

According to another aspect of the disclosure, the hair retaining clip is a contour clip, and the hair gripping component is generally shielded from contact with hair within the barrette by a base portion of the contour clip, when the second clip member is in the generally open configuration.

Figure 1:
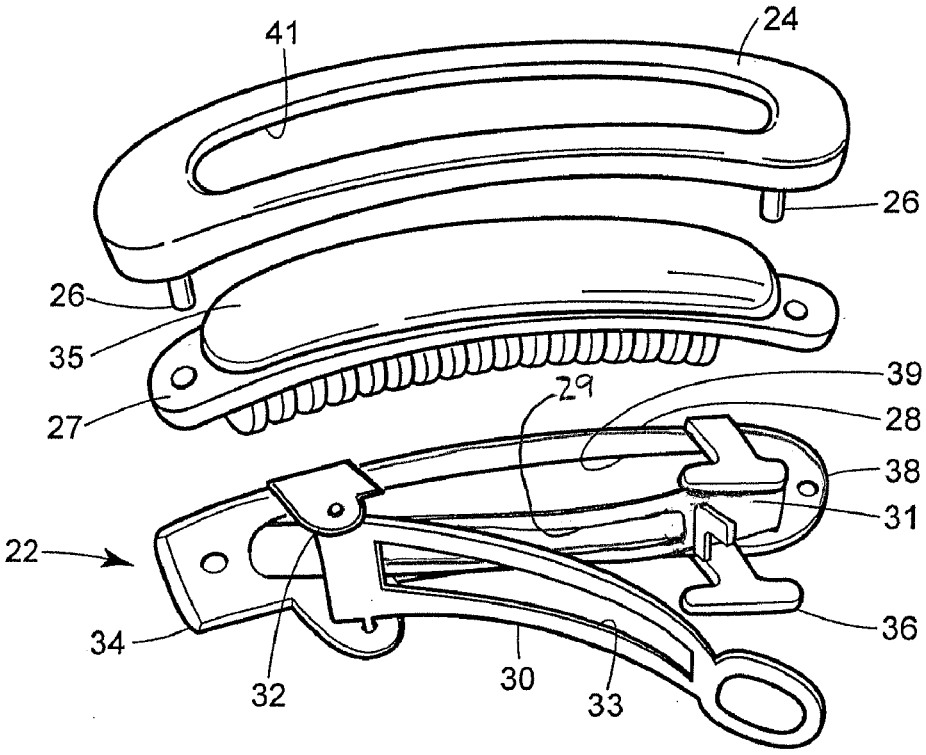
FIG. 1 is perspective diagrammatic exploded view of components of a hair retaining clip in the form of a barrette according to one embodiment of the disclosure.

While the methods and devices described herein are susceptible to various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the appended claims.

DETAILED DESCRIPTION

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited, in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 2:
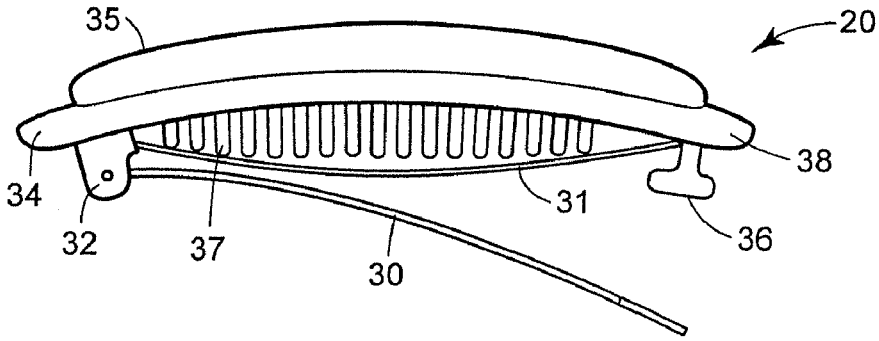
FIG. 2 is a side diagrammatic view of the hair retaining clip of FIG. 1, in a generally open configuration, viewed from a side.
Figure 3:
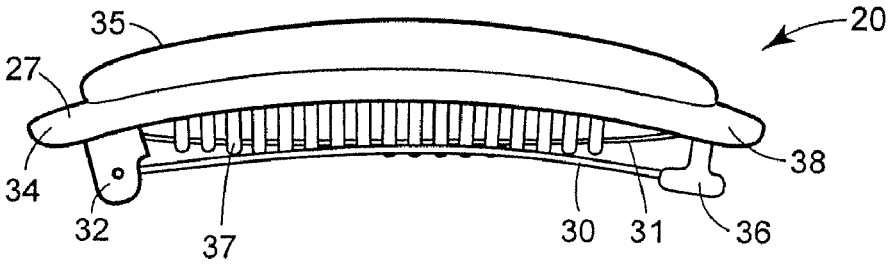
FIG. 3 is a side diagrammatic view of the hair retaining clip of FIG. 1, showing the hair retaining clip in a generally closed configuration.

With reference initially to FIGS. 1 through 3, a hair retaining clip constructed in the form of a barrette according to the teachings of the disclosure is generally depicted by reference numeral 20. As shown therein, the hair retaining clip 20 in this exemplary embodiment includes a fastener portion 22 fixedly attached to a shroud 24. The shroud 24 may be attached to the fastener portion 22 in various ways known to those skilled in the art, and in this exemplary embodiment is fastened to the fastener portion 22 via posts 26. The shroud 24 may be a separate piece from the fastener portion 22 and a hair gripping component in the form of a resilient gripping member 27 may be sandwiched between the shroud 24 and the fastener portion 22. The resilient gripping member 27 may be constructed from high friction or non-slip material, such as, for example, a soft rubber or rubber-like material (e.g., Sorbathane® material), a thermoplastic elastomer (TPE) material, a gel material, or the like.

The fastener portion 22 includes a base portion 28 operatively connected to a locking arm 30. The base portion 28 has a generally elongate shape and is fixedly attached to the shroud 24. The base portion 28 also includes a leaf spring or biasing member 31 that may be slidably and/or fixedly connected to the base portion 28. The leaf spring 31 has a generally elongate shape and, in this embodiment, is constructed from a low friction material such as, for example, chrome plated spring steel. The leaf spring 31 may also include one or more openings 29, which may be adapted to allow portions such as fins 37 of the resilient gripping member 27 to pass through the one or more openings 29 in the leaf spring 31 when the fastener portion 22 is in a closed configuration, as shown in FIG. 3. Furthermore, the leaf spring 31 may include a bow or curvature, such that leaf spring 31 can absorb a force placed on the fastener portion 22 when the clip 20 is in the closed configuration. However, when the clip 20 is in an open configuration, as shown in FIG. 2, the leaf spring 31 shields the resilient gripping member 27 from contacting hair (not shown) that is disposed between the leaf spring 31 and the locking arm 30. The locking arm 30 also has a generally elongate shape and may include one or more apertures 33 that may receive portions of the resilient gripping member 27.

A hinge or pivot mechanism 32 is disposed at a first end 34 of the fastener portion 22 and pivotally connects the base portion 28 to the locking arm 30. A locking mechanism 36 is disposed at a second end 38 of the fastener portion 22 that secures or locks the fastener portion 22 in a closed configuration. In other words, the base portion 28 has a hinge 32 that pivotally engages the locking arm 30 at one end, and the clasp or locking mechanism 36 that engages an opposite (free) end of the locking arm 30 to secure the locking arm 30 relative to the base portion 28 in a known manner when the clip 20 is in a closed configuration, as shown in FIG. 3. The resilient gripping member 27 may include a plurality of fins 37 that extend toward the locking arm 30, through an aperture 39 in the base portion 28. The resilient gripping member 27 may also include a decorative portion 35 that may extend through an aperture 41 in the shroud 24.

An operation of the hair retaining clip 20 will be herein described as retaining a bundle of hair (not shown), but it should be understood that the hair retaining clip 20 may be used to retain, hold, or be disposed on a variety of objects in a variety of ways. As best illustrated in FIGS. 2 and 3, a user may engage an open hair retaining clip 20 with a bundle of hair, such that the hair is disposed between and may contact, the surfaces of the leaf spring 31 and the locking arm 30. This permits the hair retaining clip 20 to be positioned on the hair as desired, without difficulty, since the resilient gripping member 27 is not in contact with the hair. However, once positioned as desired, the hair retaining clip 20 may then be closed by the user, and as the hair retaining clip 20 closes, the leaf spring 31 is compressed by the locking arm 30, and portions of the resilient gripping member 27 are exposed to the hair as they protrude through the one or more openings 29 in the leaf spring 31. The user may then secure the hair retaining clip 20 in a closed configuration by engaging mechanism 36 with the free end of the locking arm 30. As a result, the bundle of hair is retained in the hair retaining clip 20. The high friction or non-slip material of which the resilient gripping member 27 is constructed will aid in the retention of hair in the hair retaining clip 20.

Figure 4:
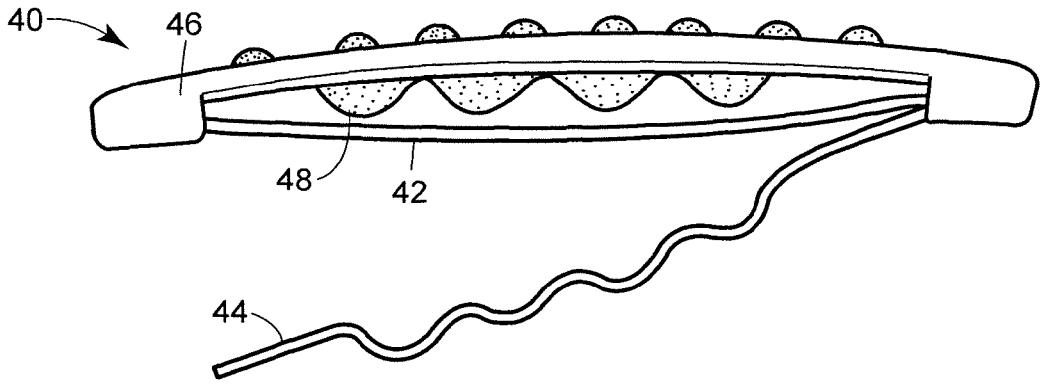
FIG. 4 is a side diagrammatic view of another embodiment of a hair retaining clip, in the form of a contour clip, in a generally open configuration, viewed from a side.
Figure 5:
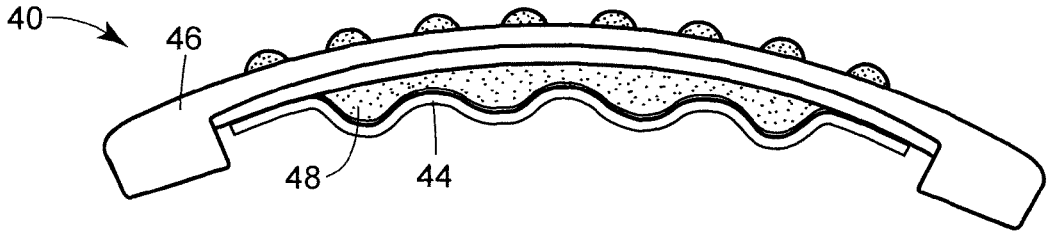
FIG. 5 is a side diagrammatic view of the hair retaining clip of FIG. 4, showing the hair retaining clip in a generally closed configuration.
Figure 6:
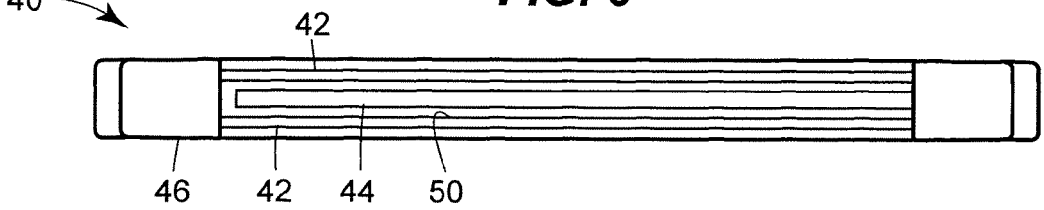
FIG. 6 is a bottom diagrammatic view of the hair retaining clip of FIG. 4, showing the hair retaining clip in a generally closed configuration.

With reference to FIGS. 4 through 6, a second embodiment of a hair retaining clip constructed in the form of a contour clip according to the teachings of the disclosure is generally depicted by reference numeral 40. The contour clip 40 includes a base 42 and an integral arm 44 that extends from the base 42 and is at least partially disposed on an opening of the base 42. The contour clip 40 may be constructed from a plastic or metal material capable of providing the biasing force necessary to open and close the contour clip 40. Specifically, the contour clip 40 as illustrated in FIG. 4 is in an open configuration such that the base 42 has a convex shape relative to the integral arm 44. More specifically, in the open configuration, the base 42 has a convex shape such that a free end of the integral arm 44 is disposed apart from the base 42.

In closing the contour clip 40, the user forces the base 42 from the convex shape to a concave shape, in essence snapping the contour clip 40 from an open configuration to a closed configuration. In the closed configuration, the base 42 has an overall concave shape complementary to that of the integral arm 44, such that the free end of the integral arm 44 is disposed adjacent the base 42, thereby retaining the hair between the integral arm 44 and the base 42. In other words, the user forces the base 42 from the convex shape to a concave shape, in essence snapping the contour clip 40 from an open configuration to a closed configuration.

A shroud 46 may be attached to the base 42. A resilient gripping member 48 (shown with stippling) may be mounted to the shroud 46 such that the resilient gripping member 48 is disposed between the shroud 46 and the base 42. As is the case with the embodiment discussed above, the resilient member 48 may be constructed from high friction or non-slip material, such as, for example, a soft rubber or rubber-like material (e.g., Sorbathane® material), a thermoplastic elastomer (TPE) material, a gel material, or the like.

The base 42 may have a central gap 50 that extends substantially along the length of the base 42. The resilient gripping member 48 extends through the gap 50 and contacts the integral arm 44 when the contour clip 40 is in the closed configuration, as illustrated in FIG. 5. The resilient gripping member 48 may have an undulating surface, and the integral arm 44 may have a corresponding geometry such that it follows the contours of the resilient gripping member 48 when the contour clip 40 is in the closed configuration. When the contour clip 40 is in the open configuration, the resilient gripping member 48 is prevented from contacting the user's hair disposed between the integral arm 44 and the base 42, by surfaces of the base 42 that extend beyond the surface of the resilient gripping member 48 when the contour clip 40 is in the open configuration, as illustrated in FIG. 4.

Figure 7:
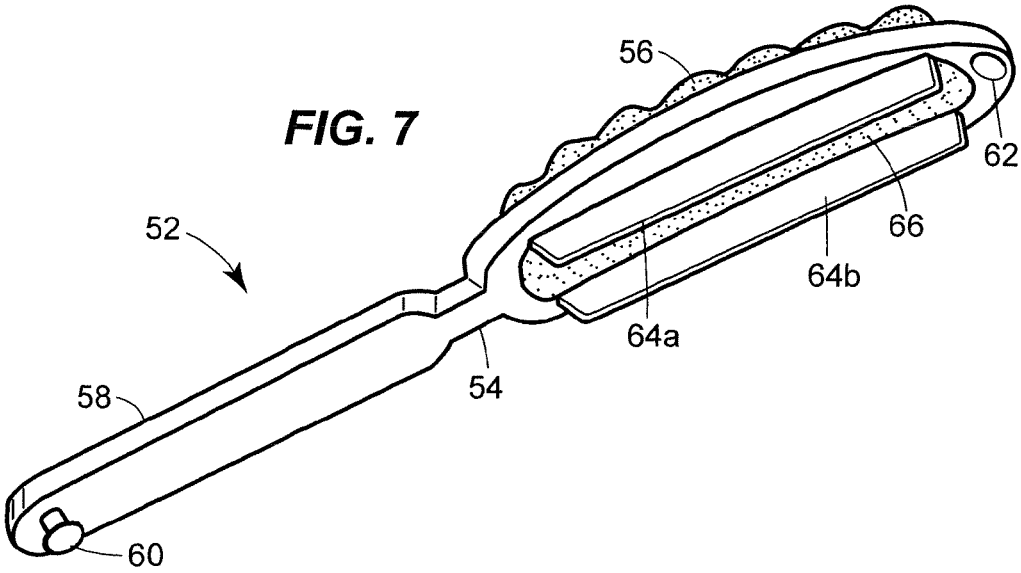
FIG. 7 is a plan perspective view of another embodiment of a hair retaining clip, in the form of a living hinge barrette, in a generally open configuration.

With reference to FIG. 7, a living hinge barrette 52 includes a living hinge 54 that connects a base portion 56 to a locking arm 58. The locking arm 58 may include a male latching member 60 that engages a latching aperture 62 on the base portion when the living hinge barrette 52 is in a closed configuration. The base portion and the locking arm may be made of any suitable relatively hard material, such as injection molded plastic. The base portion 56 may include walls 64*a* and 64*b* that may each have undulating surfaces. A resilient gripping member 66 may be disposed on the base portion 56 between the walls 64*a* and 64*b*, such that when the living hinge barrette 52 is in the open configuration, the walls 64*a* and 64*b* prevent the user's hair from contacting the resilient gripping member 48. However, when the living hinge barrette 52 is in the closed configuration, the locking arm presses the user's hair into contact with the resilient gripping member 66, therefore firmly gripping the user's hair within the living hinge barrette 52. As is the case with the embodiments discussed above, the resilient gripping member 66 may be constructed from high friction or non-slip material, such as, for example, a soft rubber or rubber-like material (e.g., Sorbathane® material), a thermoplastic elastomer (TPE) material, a gel material, or the like. The resilient material of the resilient gripping member 66, shown with stippling, may also be disposed on the outer surface of the base portion 56.

Figure 8:
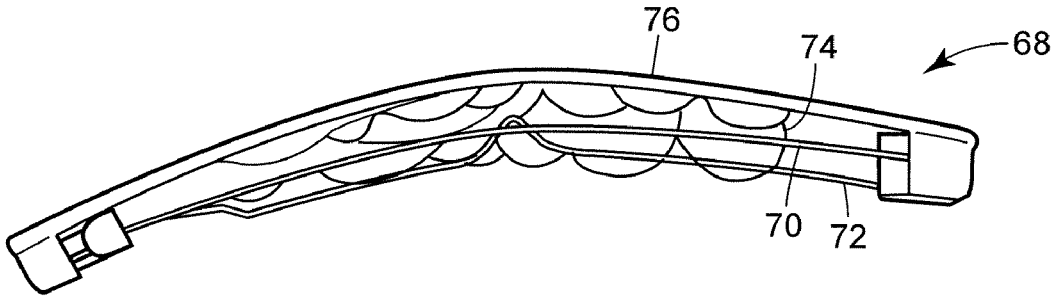
FIG. 8 is a side perspective diagrammatic view, of another embodiment of a hair retaining clip, in the form of a contour clip, in a generally closed configuration.
Figure 9:
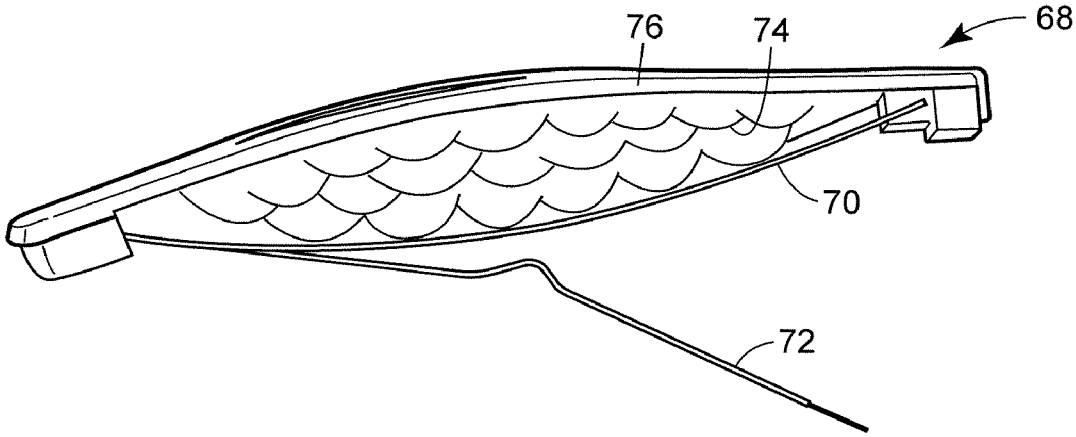
FIG. 9 is a side perspective diagrammatic view of the hair retaining clip of FIG. 8, in a generally open configuration.
Figure 10:
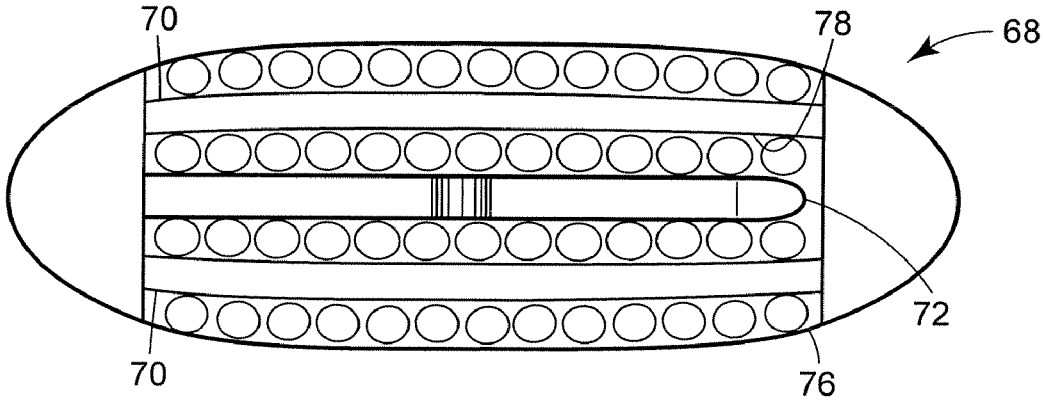
FIG. 10 is a bottom diagrammatic view of the hair retaining clip of FIG. 8, showing the hair retaining clip in a generally closed configuration.

FIGS. 8 through 10 depict a contour clip 68, substantially similar to that of FIGS. 4 through 6. The contour clip 68 includes a base portion 70 and an integral arm 72 that extends from the base portion 70. The contour clip 68 may be constructed from a plastic or metal material capable of providing the biasing force necessary to open and close the contour clip 68.

A shroud 76 may be attached to the base portion 70. A resilient gripping member 74 may be mounted to the shroud 76 such that the resilient gripping member 74 is disposed between the shroud 76 and the base portion 70. As is the case with the embodiments discussed above, the resilient gripping member 74 may be constructed from high friction or non-slip material, such as, for example, a soft rubber or rubber-like material (e.g., Sorbathane® material), a thermoplastic elastomer (TPE) material, a gel material, or the like.

The base portion 70 may have a central gap 78 that extends substantially along the length of the base portion 70. The resilient gripping member 74 extends through the gap 78 and contacts the integral arm 72 when the contour clip 68 is in the closed configuration, as illustrated in FIG. 8. The resilient gripping member 74 may have bulbous surface. When the contour clip 68 is in the open configuration, the resilient gripping member 74 is prevented from contacting the user's hair disposed between the integral arm 72 and the base portion 70, by surfaces of the base portion 70 that extend beyond the surface of the resilient gripping member 74 when the contour clip 68 is in the open configuration, as illustrated in FIG. 9.

The above exemplary embodiments may be varied or altered to achieve and create similar, additional or alternative features. For example, even though the above exemplary embodiment is describing certain types of hair clips, the sprit and scope of the invention covers other types of hair clips, such as other types of barrettes, snap clips, living hinge clips, etc.

The resilient gripping member for solid hair accessories, such as wood, plastic, or metal, can be achieved by coating portions of the hair accessory with a vinyl or epoxy type product, lining or wrapping the product with a rubber or other gripping material including Velcro® material, or by manufacturing a product that has two components (i.e. a two shot injection molding machine where a TPE coating is applied over a plastic part). The resilient gripping member can be applied during the initial manufacturing step or in a secondary operation.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed is:

1. A hair retaining clip comprising:

a first clip member;

a second clip member pivotally connected to the first clip member, wherein the first and second clip members are movable between a generally open configuration and a generally closed configuration;

a hair gripping component, fixedly attached to the first clip member, that is made from a relatively soft material; and a biasing member, fixedly attached to the first clip member and positioned between the first clip member and the second clip member when the hair retaining clip is in the generally open configuration, wherein the hair gripping component extends from the first clip member toward, but does not extend past, the biasing member such that the hair gripping component is shielded from contact with hair within the hair retaining clip by the interposed biasing member when the hair retaining clip is in the open configuration, and the interposed biasing member is compressed by the second clip member to a position where at least a portion of the hair gripping component extends beyond the biasing member and contacts the hair within the hair retaining clip when the hair retaining clip is in the closed configuration.

2. The hair retaining clip of claim 1, wherein the hair retaining clip includes a living hinge connecting the first clip member to the second clip member.

3. The hair retaining clip of claim 1, wherein the hair retaining clip is a barrette.

4. The hair retaining clip of claim 1, wherein the hair retaining clip is a contour clip.

5. The hair retaining clip of claim 1, wherein the biasing member includes at least one opening through which at least a portion, of the hair-gripping component extends when the second clip member is in the generally closed configuration and through which the hair-gripping component does not extend when the second clip member is in the generally open configuration.

6. The hair retaining clip of claim 1, wherein the biasing member is a leaf spring.

7. The hair retaining clip of claim 6, wherein the leaf spring is bowed outward toward the second clip member to shield the hair-gripping component from contact with the hair within the hair retaining clip when the second clip member is in the generally open configuration.

8. The hair retaining clip of claim 1, wherein the biasing member includes a relatively low-friction material.

9. The hair retaining clip of claim 8, wherein the biasing member is made of a plated spring steel.

10. The hair retaining clip of claim 1, wherein the hair-gripping component includes a relatively high-friction material that grips the hair with greater frictional force than the biasing member.

11. The hair retaining clip of claim 1, wherein the second clip member includes one or more apertures through which at least a portion of the hair-gripping component extends when the second clip member is in the generally closed configuration and through which the hair-gripping component does not extend when the second clip member is in the generally open configuration.

12. A hair retaining clip comprising:

a base portion;

a movable arm pivotally connected to the base portion that is movable between a generally open configuration and a generally closed configuration;

a resilient gripping member, fixedly attached to the base portion, that is made from a relatively soft material;

a leaf spring connected to the base portion, positioned between the base portion and the movable arm when the movable arm is in the generally open configuration, and including at least one opening, wherein the interposed leaf spring is bowed outward toward the movable arm to shield the resilient gripping member from contact with hair within the hair retaining clip, with the hair-gripping component not extending through the leaf spring opening, or otherwise extending past the leaf spring when the movable arm is in the generally open configuration, and wherein the interposed leaf spring is compressed inward by the movable arm and at least a portion of the resilient gripping member extends through the opening in the interposed leaf spring and contacts the hair within the hair retaining clip when the movable arm is in the generally closed configuration.

13. The hair retaining clip of claim 12, wherein the hair retaining clip is a barrette.

14. The hair retaining clip of claim 12, wherein the hair retaining clip is a contour clip.

15. The hair retaining clip of claim 12, wherein the leaf spring includes a relatively low-friction material.

16. The hair retaining clip of claim 15, wherein the leaf spring is made of a plated spring steel.

17. The hair retaining clip of claim 12, wherein the resilient gripping member includes a relatively high-friction material that grips the hair with greater frictional force than the leaf spring.

18. The hair retaining clip of claim 12, wherein the movable arm includes one or more apertures through which at least a portion of the resilient gripping member extends when the movable arm is in the generally closed configuration and through which the resilient gripping member does not extend when the movable arm is in the generally open configuration.

19. The hair retaining clip of claim 12, wherein the base portion, the movable arm, and the leaf spring in combination define a fastener portion of the hair retaining clip, and further comprising a shroud, wherein the resilient gripping member is sandwiched between the shroud and the fastener portion, and wherein the base portion includes an aperture through which at least a portion of the resilient gripping member extends.

20. The hair retaining clip of claim 12, wherein the resilient gripping member includes a plurality of fins that define the portion of the resilient gripping member that extends through the leaf spring opening when the movable arm is in the generally closed configuration.

* * * * *

UNITED STATES PATENT AND TRADEMARK OFFICE

CERTIFICATE OF CORRECTION

PATENT NO. : 7,766,020 B2
APPLICATION NO. : 11/647923
DATED : August 3, 2010
INVENTOR(S) : Stephen Chinnis et al.

It is certified that error appears in the above-identified patent and that said Letters Patent is hereby corrected as shown below:

In column 6, in Claim 1 at line 9, delete the "," after the words "a biasing member" and before "fixedly attached to the first clip member..."

In column 7, in Claim 12 at line 16, delete the "," after the words "through the leaf spring opening" and before "or otherwise extending past the leaf spring when..."

Signed and Sealed this

Fourteenth Day of December, 2010

David J. Kappos

David J. Kappos
*Director of the United States Patent and Trademark Office*